US012510102B1

(12) United States Patent
Nakamura

(10) Patent No.: US 12,510,102 B1
(45) Date of Patent: Dec. 30, 2025

(54) UMBRELLA CLAMPING FAN

(71) Applicant: LABELLA CO., LTD, Tokyo (JP)

(72) Inventor: Shinnzi Nakamura, Tokyo (JP)

( * ) Notice: Subject to any disclaimer, the term of this patent is extended or adjusted under 35 U.S.C. 154(b) by 0 days.

(21) Appl. No.: 19/033,762

(22) Filed: Jan. 22, 2025

(51) Int. Cl.
*F04D 29/64* (2006.01)
*F04D 19/02* (2006.01)
*F04D 29/52* (2006.01)

(52) U.S. Cl.
CPC ..... *F04D 29/646* (2013.01); *F04D 19/022* (2013.01); *F04D 29/522* (2013.01)

(58) Field of Classification Search
CPC ..... F04D 29/646; F04D 29/522; F04D 19/002
See application file for complete search history.

(56) References Cited

FOREIGN PATENT DOCUMENTS

| | | | | |
|---|---|---|---|---|
| CN | 201691207 U | * | 1/2011 | |
| CN | 111631494 A | * | 9/2020 | ..... F04D 25/08 |
| CN | 212615467 U | | 2/2021 | |

* cited by examiner

*Primary Examiner* — Michael L Sehn

(57) ABSTRACT

An umbrella clamping fan is provided, which includes a fan body and a clamping part. The clamping part includes a clamping base and a clamping flip cover that are connected. An umbrella rod receiving chamber is provided between the clamping base and the clamping flip cover, two ends of the umbrella rod receiving chamber penetrate opposite sides of the clamping part. One side of a wall of the umbrella rod receiving chamber is provided with an elastic fastening mechanism, which is extended into an interior of the umbrella rod receiving chamber under a normal condition. When the clamping part is clamped on an umbrella support rod, a main body of the umbrella support rod is accommodated in the umbrella rod receiving chamber, and the elastic fastening mechanism abuts against the umbrella rod receiving chamber, which renders the clamping part adaptable to various umbrella support rods with different outer diameters.

10 Claims, 5 Drawing Sheets

UMBRELLA CLAMPING FAN

TECHNICAL FIELD

The present disclosure relates to the field of fan technologies, and in particular, to an umbrella clamping fan.

BACKGROUND

Personal fans are appliances used for blowing and cooling in hot weather, and are favored by consumers due to their practical functions.

In summer, due to the strong sunlight, people often use umbrellas for shade and sun protection when going out. When using umbrellas, people need to free up hands to hold them. In this case, it is difficult for people to free up other hands to hold fans for blowing and cooling, which seriously limits the use of personal fans while holding umbrellas. In response to this phenomenon, Chinese utility model of CN212615467U has disclosed a technical solution for "blowing fan applied to umbrella". This technical solution enables a personal fan to be clamped and used on an umbrella support rod, thereby saving manpower and resources, and to some extent solving the usage defects.

However, this technical solution is prone to the occurrence of cover plate cracking or loose clamping during implementation, because the outer diameters of different styles of umbrella support rods are often different. If used on umbrella support rods with larger outer diameters, the cover plate may crack due to interference fitting, while when used on umbrella support rods with smaller outer diameters, the phenomenon of loose clamping or abnormal clamping may occur due to inability to clamp, which seriously weakens the effectiveness and applicability of the technical solution.

SUMMARY

The purpose of the present disclosure is to provide an umbrella clamping fan, which is provided with an elastic fastening mechanism at a wall surface of an umbrella rod receiving chamber. Through the elastic fastening mechanism, the umbrella support rod can be adaptively clamped, so that a clamping part can be adapted to various umbrella support rods with different outer diameters, and the clamping effect is stable and not loose, with strong practicality, thereby solving problems proposed in the background technology mentioned above.

In order to achieve the above objectives, the present disclosure provides the following technical solution: an umbrella clamping fan, including a fan body and a clamping part integrally connected to the fan body, where the clamping part includes a clamping base and a clamping flip cover that are connected; an umbrella rod receiving chamber is provided between the clamping base and the clamping flip cover; two ends of the umbrella rod receiving chamber penetrate opposite sides of the clamping part; one side of a wall of the umbrella rod receiving chamber is provided with an elastic fastening mechanism, which is extended into an interior of the umbrella rod receiving chamber toward one end of the umbrella rod receiving chamber under a normal condition; when the clamping part is clamped on an umbrella support rod, a part of a main body of the umbrella support rod is accommodated in the umbrella rod receiving chamber; at this time, the elastic fastening mechanism is elastically connected to the umbrella support rod.

In some embodiments of the present disclosure, the elastic fastening mechanism includes a pressure plate sliding chamber provided in the clamping flip cover, a pressure plate provided in the pressure plate sliding chamber, limited in the pressure plate sliding chamber and sliding along an axial direction of the pressure plate sliding chamber, and a group of springs provided between the pressure plate and the pressure plate sliding chamber.

In some embodiments of the present disclosure, the pressure plate sliding chamber is provided with a plurality of limit claws that are axially extending in a circumferential direction of the pressure plate sliding chamber; the plurality of limit claws are enclosed to form the pressure plate sliding chamber; the pressure plate is provided in the pressure plate sliding chamber, and the pressure plate is capable of sliding along a length direction of the limit claws.

In some embodiments of the present disclosure, a second damping element is attached to one side of the pressure plate facing away from the springs.

In some embodiments of the present disclosure, the clamping base includes a base outer shell and a base inner shell that are connected; an accommodation cavity is formed between the base outer shell and the base inner shell; and the accommodation cavity is provided with a circuit board component and a battery that are electrically connected to each other; the circuit board component is electrically connected with a control button and a power interface; the control button and the power interface are provided in a predetermined through hole of the base outer shell and are extended outward from the through hole.

In some embodiments of the present disclosure, two ends of an upper of the clamping part that are perpendicular to the umbrella rod receiving chamber are provided with a locking component and a second rotating mechanism; the clamping base and the clamping flip cover are detachably connected through the locking component; the clamping base and the clamping flip cover are rotatably connected through the second rotating mechanism.

In some embodiments of the present disclosure, the locking component includes a locking seat provided on the clamping base and a locking tongue provided on the clamping flip cover; the second rotating mechanism includes a second shaft seat provided on the clamping base, a second shaft sleeve provided on the clamping flip cover, and a rotating shaft configured to connect the second shaft seat and the second shaft sleeve.

In some embodiments of the present disclosure, the fan body and the clamping part are rotatably connected through a first rotating mechanism; where the first rotating mechanism includes a rotating arm integrally connected with the fan body, a first shaft seat and a rotating shaft assembly integrally connected with the clamping base; where a first shaft sleeve is provided at one end of the rotating arm away from the fan body, and the rotating shaft assembly is connected in series with the first shaft sleeve and the first shaft seat to realize a rotational connection between the fan body and the clamping part.

In some embodiments of the present disclosure, a corrugated surface is provided on an outer side of the first shaft sleeve, and a positioning damping member is provided in the first shaft seat, the positioning damping member abuts against the corrugated surface to achieve a gap positioning during a rotation of the fan body relative to the clamping part.

In some embodiments of the present disclosure, a first damping element is attached to a wall surface of the umbrella rod receiving chamber facing the elastic fastening mechanism.

Compared with existing technology, the beneficial effects of the present disclosure are as following.

The present disclosure is provided with an elastic fastening mechanism at a wall surface of an umbrella rod storage chamber. Through the elastic fastening mechanism, the umbrella support rod is adaptively clamped, so that the clamping part can be adapted to various umbrella support rods with different outer diameters, and the clamping effect is stable and not loose, with strong practicality.

Numeral reference: 1 fan body; 2 clamping part; 21 clamping base; 211 base outer shell; 212 circuit board component; 213 control button; 214 power interface; 215 battery; 216 base inner shell; 217 first damping element; 218 locking seat; 22 clamping flip cover; 221 pressure plate sliding chamber; 222 limit claw; 223 locking tongue; 224 spring; 225 pressure plate; 226 second damping element; 23 umbrella rod receiving chamber; 24 second rotating mechanism; 241 second shaft sleeve; 242 rotating shaft; 243 second shaft seat; 3 first rotating mechanism; 31 rotating arm; 32 first shaft sleeve; 33 corrugated surface; 34 rotating shaft assembly; 35 positioning damping member; 36 first shaft seat; 4 umbrella support rod.

DESCRIPTION OF EMBODIMENTS

The following will provide a clear and complete description of the technical solution in the embodiments of the present disclosure, based on the accompanying drawings. Obviously, the described embodiments are only a part of the embodiments of the present disclosure, not all of them. Based on the embodiments in the present disclosure, all other embodiments obtained by those skilled in the art without creative work are within the protection scope of the present disclosure.

Figure 1:
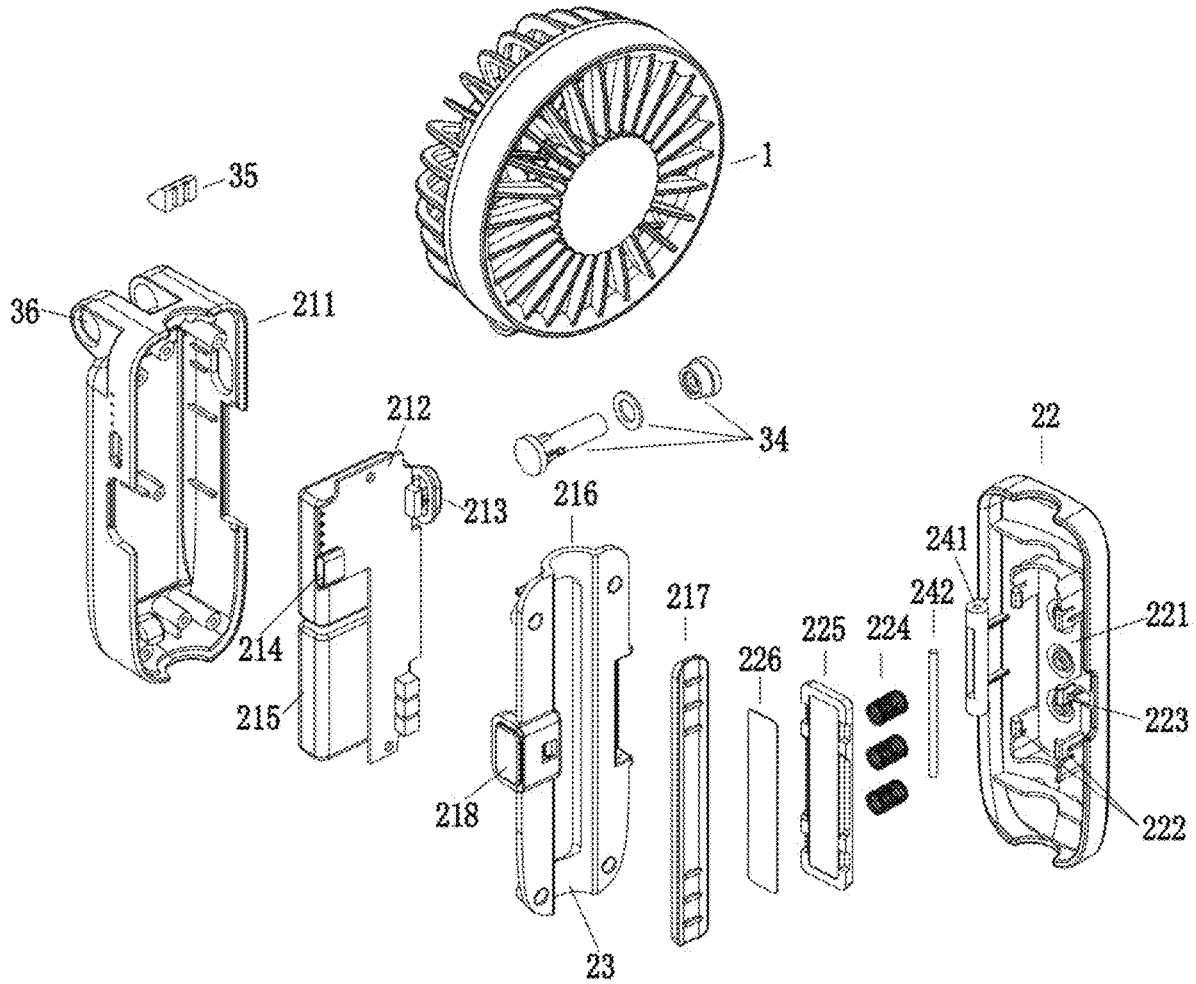
FIG. 1 is a first exploded structure view of the present disclosure.
Figure 2:
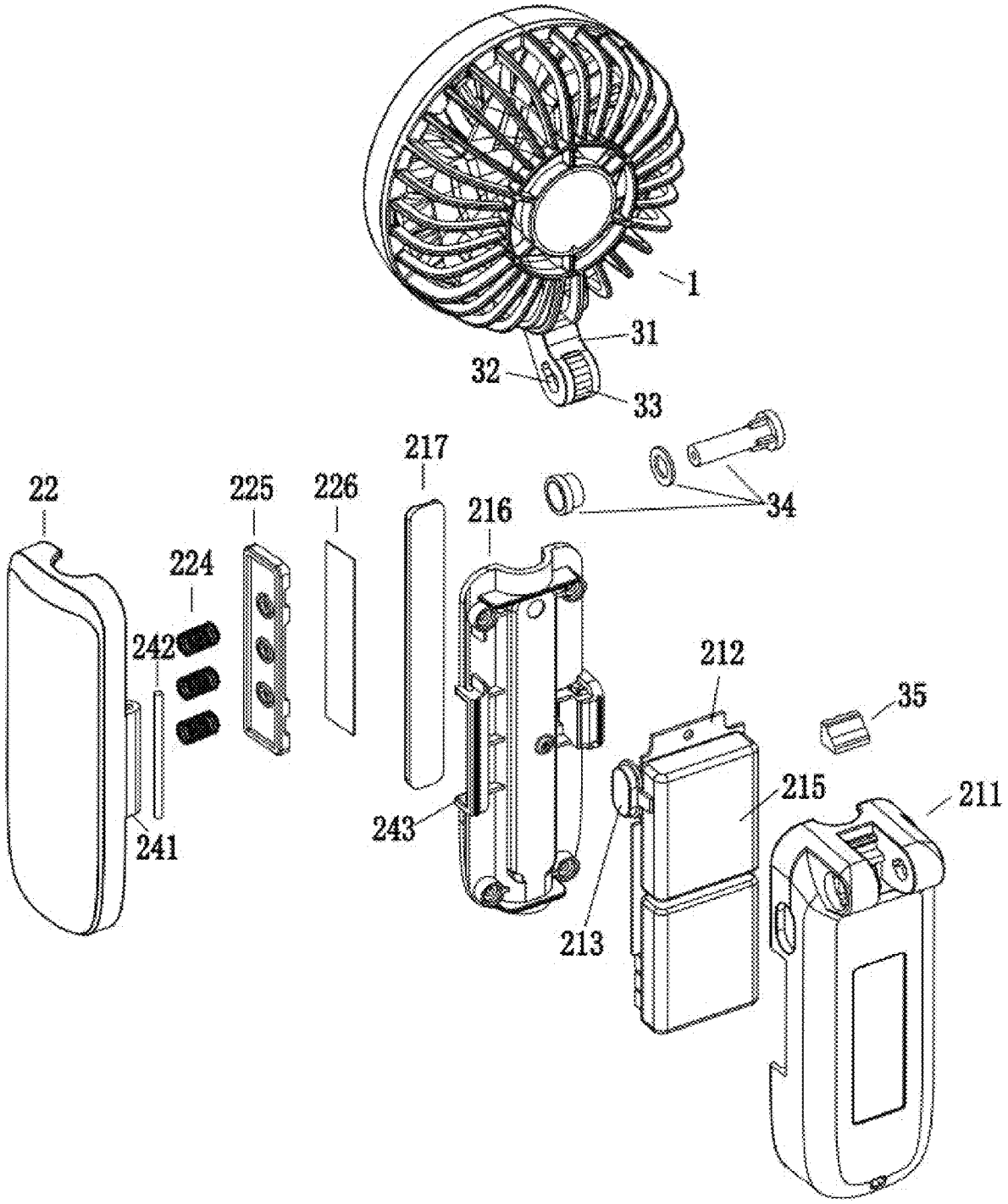
FIG. 2 is a second exploded structure view of the present disclosure.
Figure 3:
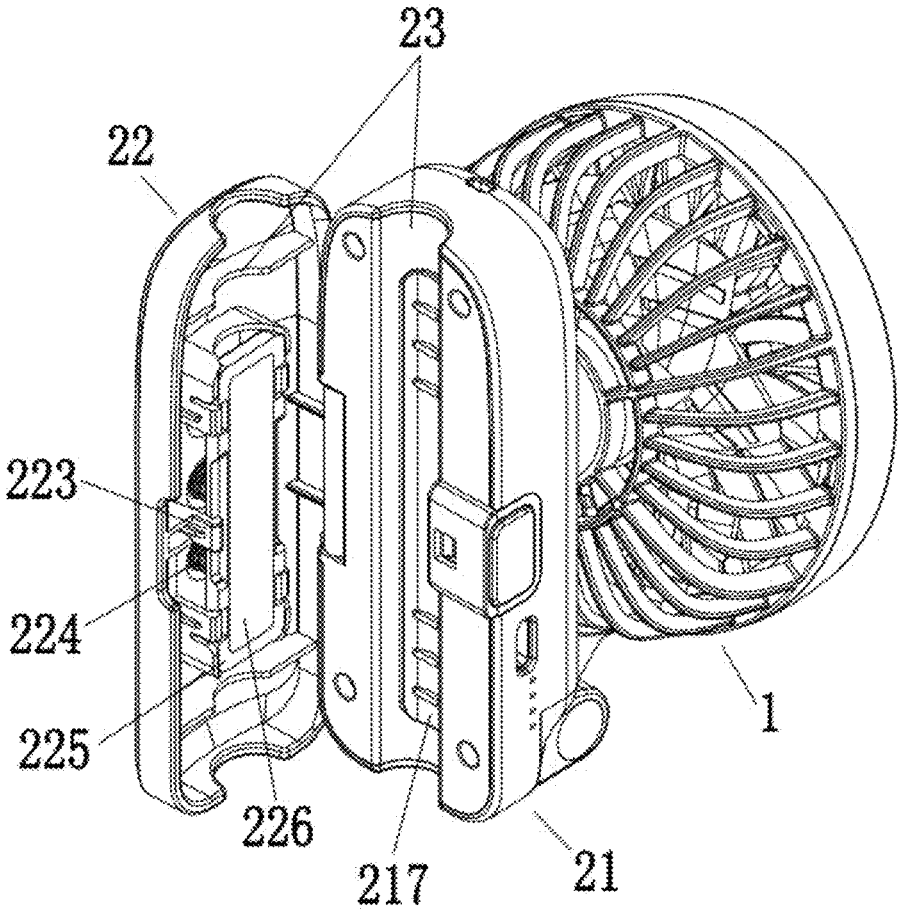
FIG. 3 is a first use state reference diagram of the present disclosure.
Figure 4:
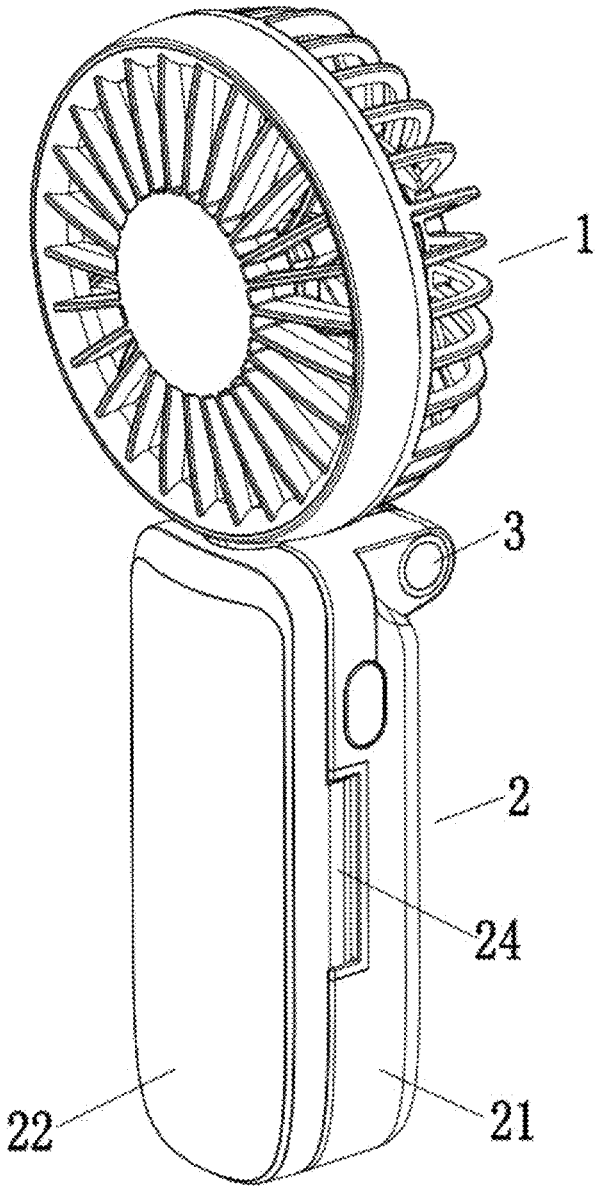
FIG. 4 is a second use state reference diagram of the present disclosure.
Figure 5:
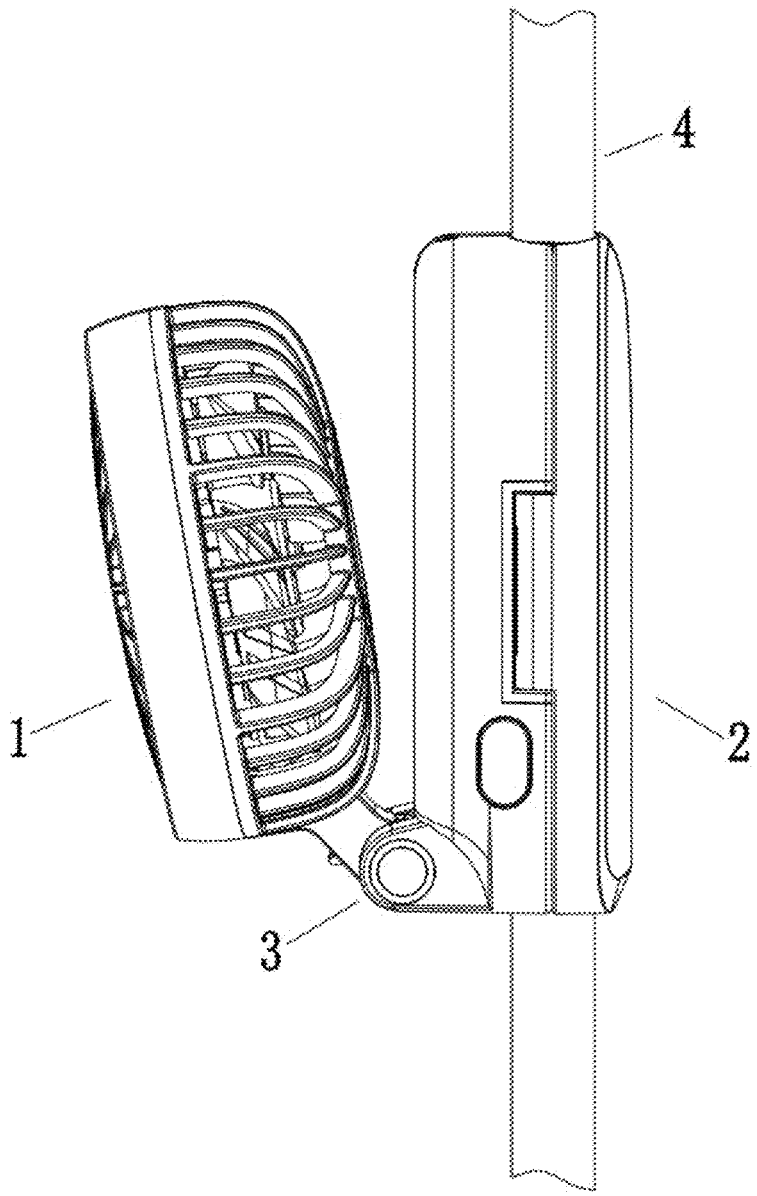
FIG. 5 is a third use state reference diagram of the present disclosure.

Please refer to FIGS. 1-5, an umbrella clamping fan including a fan body 1 and a clamping part 2 integrally connected to the fan body 1. The clamping part 2 includes a clamping base 21 and a clamping flip cover 22 that are mutually covered and connected. An umbrella rod receiving chamber 23 is provided between the clamping base 21 and the clamping flip cover 22; two ends of the umbrella rod receiving chamber 23 are arranged opposite to each other through the clamping part 2. One side of a wall of the umbrella rod receiving chamber 23 is provided with an elastic fastening mechanism, which is extended into an interior of the umbrella rod receiving chamber 23 under a normal condition towards one end of the umbrella rod receiving chamber 23. When the clamping part 2 is clamped on an umbrella support rod 4, a main body of the umbrella support rod 4 is accommodated in the umbrella rod receiving chamber 23, and at this time, the elastic fastening mechanism is elastically connected to the umbrella support rod 4.

The elastic fastening mechanism includes a pressure plate sliding chamber 221 located in the clamping flip cover 22, a pressure plate 225 located in the pressure plate sliding chamber 221, limited to the pressure plate sliding chamber 221 and sliding axially along the pressure plate sliding chamber 221, and a group of springs 224 provided between the pressure plate 225 and the pressure plate sliding chamber 221. The pressure plate sliding chamber 221 is provided with a plurality of limit claws 222 that are axially extending in a circumferential direction of the pressure plate sliding chamber 221, and the limit claws 222 are enclosed to form the pressure plate sliding chamber 221. The pressure plate 225 is provided in the pressure plate sliding chamber 221 and can slide along a length direction of the limit claws 222. A second damping element 226 is attached to one side of the pressure plate 225 facing away from the spring group 224, and a first damping element 217 is attached to a wall of the umbrella rod receiving chamber 23 facing the elastic fastening mechanism. The use of the first damping element 217 and the second damping element 226 in combination with clamping the umbrella support rod 4 can enhance a damping effect of the clamping, thereby strengthening the stability of clamping and reducing the occurrence of sliding and displacement.

The clamping base 21 includes a base outer shell 211 and a base inner shell 216 that are mutually covered and connected. A accommodation cavity is formed between the base outer shell 211 and the base inner shell 216. The accommodation cavity is provided with a circuit board component 212 and a battery 215 that are electrically connected to each other. The circuit board component 212 is electrically connected with a control button 213 and a power interface 214. The control button 213 and the power interface 214 are provided in a predetermined through-hole of the base outer shell 211 and are extended outward from the through-hole. The fan body 1 is electrically connected to the circuit board component 212 through internal wiring of the shell. The control button 213 is configured to adjust a working mode for controlling the fan body 1. The power interface 214 uses a charging cable to connect to an external power supply. At this time, the battery 215 can be charged to replenish electrical energy.

The clamping part 2 is provided with a locking component and a second rotating mechanism 24 at two ends that are perpendicular to the umbrella rod receiving chamber 23. The clamping base 21 and the clamping flip cover 22 are detachably connected through the locking component; the clamping base 21 and the clamping flip cover 22 are rotatably connected through the second rotating mechanism 24. The locking component includes a locking seat 218 provided on the clamping base 21 and a locking tongue 223 provided on the clamping flip cover 22. The second rotating mechanism 24 include a second shaft seat 243 provided on the clamping base 21, a second shaft sleeve 241 provided on the clamping flip cover 22, and a rotating shaft 242 for connecting the second shaft seat 243 and the second shaft sleeve 241.

The fan body 1 and the clamping part 2 are rotatably connected through a first rotating mechanism 3. The first rotating mechanism 3 includes a rotating arm 31 integrally connected to the fan body 1, a first shaft seat 36 integrally connected to the clamping base 21, and a rotating shaft assembly 34. The rotating arm 31 is provided with a first shaft sleeve 32 at one end away from the fan body 1, and the rotating shaft assembly 34 is connected in series with the first shaft sleeve 32 and the first shaft seat 36 to achieve a rotational connection between the fan body 1 and the clamping part 2. A corrugated surface 33 is provided on an outer side of the first shaft sleeve 32, and a positioning damping member 35 is provided in the first shaft seat 36. The positioning damping member 35 abuts against the corrugated surface 33 to achieve a gap positioning during a rotation of the fan body 1 relative to the clamping part 2.

In summary, the present disclosure is provided with an elastic fastening mechanism at the wall of the umbrella rod receiving chamber 23. Through the elastic fastening mechanism, the umbrella support rod 4 is adaptively clamped, so that the clamping part 2 can be adapted to various umbrella support rods 4 with different outer diameters, and the clamping effect is stable and not loose, with strong practicality.

It should be noted that in this specification, relational terms such as first and second are only used to distinguish one entity or operation from another, and do not necessarily require or imply any actual relationship or order between these entities or operations. Moreover, the terms "including", "having", or any other variation thereof are intended to encompass non-exclusive inclusion, such that a process, method, item, or device that includes a series of elements includes not only those elements, but also other elements not explicitly listed, or elements inherent to such process, method, item, or device.

Although the embodiments of the present disclosure have been shown and described, it will be understood by those skilled in the art that various changes, modifications, substitutions, and variations can be made to these embodiments without departing from the principles and spirit of the present disclosure. The scope of the present disclosure is limited by the appended claims and their equivalents.

What is claimed is:

1. An umbrella clamping fan, comprising a fan body and a clamping part integrally connected to the fan body, wherein the clamping part comprises a clamping base and a clamping flip cover that are connected;

an umbrella rod receiving chamber is provided between the clamping base and the clamping flip cover;

two ends of the umbrella rod receiving chamber penetrate opposite sides of the clamping part;

one side of a wall of the umbrella rod receiving chamber is provided with an elastic fastening mechanism, which is extended into an interior of the umbrella rod receiving chamber toward one end of the umbrella rod receiving chamber under a normal condition;

when the clamping part is clamped on an umbrella support rod, a part of a main body of the umbrella support rod is accommodated in the umbrella rod receiving chamber; and the elastic fastening mechanism is elastically connected to the umbrella support rod.

2. The umbrella clamping fan according to claim 1, wherein the elastic fastening mechanism comprises a pressure plate sliding chamber provided in the clamping flip cover, a pressure plate provided in the pressure plate sliding chamber, limited in the pressure plate sliding chamber and sliding along an axial direction of the pressure plate sliding chamber, and a group of springs provided between the pressure plate and the pressure plate sliding chamber.

3. The umbrella clamping fan according to claim 2, wherein the pressure plate sliding chamber is provided with a plurality of limit claws that are axially extending in a circumferential direction of the pressure plate sliding chamber;

the plurality of limit claws are enclosed to form the pressure plate sliding chamber;

the pressure plate is provided in the pressure plate sliding chamber, and the pressure plate is capable of sliding along a length direction of the limit claws.

4. The umbrella clamping fan according to claim 3, wherein a second damping element is attached to one side of the pressure plate facing away from the springs.

5. The umbrella clamping fan according to claim 1, wherein the clamping base comprises a base outer shell and a base inner shell that are connected;

an accommodation cavity is formed between the base outer shell and the base inner shell; and the accommodation cavity is provided with a circuit board component and a battery that are electrically connected to each other;

the circuit board component is electrically connected with a control button and a power interface;

the control button and the power interface are provided in a predetermined through hole of the base outer shell and are extended outward from the through hole.

6. The umbrella clamping fan according to claim 1, wherein two ends of an upper of the clamping part that are perpendicular to the umbrella rod receiving chamber are provided with a locking component and a second rotating mechanism;

the clamping base and the clamping flip cover are detachably connected through the locking component;

the clamping base and the clamping flip cover are rotatably connected through the second rotating mechanism.

7. The umbrella clamping fan according to claim 6, wherein the locking component comprises a locking seat provided on the clamping base and a locking tongue provided on the clamping flip cover;

the second rotating mechanism comprises a second shaft seat provided on the clamping base, a second shaft sleeve provided on the clamping flip cover, and a rotating shaft configured to connect the second shaft seat and the second shaft sleeve.

8. The umbrella clamping fan according to claim 1, wherein the fan body and the clamping part are rotatably connected through a first rotating mechanism;

wherein the first rotating mechanism comprises a rotating arm integrally connected with the fan body, a first shaft seat and a rotating shaft assembly integrally connected with the clamping base;

wherein a first shaft sleeve is provided at one end of the rotating arm away from the fan body, and the rotating shaft assembly is connected in series with the first shaft sleeve and the first shaft seat to realize a rotational connection between the fan body and the clamping part.

9. The umbrella clamping fan according to claim 8, wherein a corrugated surface is provided on an outer side of the first shaft sleeve, and a positioning damping member is provided in the first shaft seat, the positioning damping member abuts against the corrugated surface to achieve a gap positioning during a rotation of the fan body relative to the clamping part.

10. The umbrella clamping fan according to claim 1, wherein a first damping element is attached to a wall surface of the umbrella rod receiving chamber facing the elastic fastening mechanism.

* * * * *